United States Patent [19]

Sharma et al.

[11] Patent Number: 4,741,515

[45] Date of Patent: May 3, 1988

[54] APPARATUS FOR INTRODUCING GAS INTO A METALLURGICAL VESSEL

[75] Inventors: Sudhir K. Sharma, Center Valley; Guido P. Brita, Bethlehem; Philip D. Stelts, Center Valley, all of Pa.

[73] Assignee: Bethlehem Steel Corporation, Bethlehem, Pa.

[21] Appl. No.: 920,631

[22] Filed: Oct. 20, 1986

[51] Int. Cl.[4] ..... C21C 5/48

[52] U.S. Cl. ..... 266/266; 266/99; 266/218

[58] Field of Search ..... 266/47, 99, 218, 220, 266/265; 266, 270

[56] References Cited

U.S. PATENT DOCUMENTS

| | | | |
|---|---|---|---|
| 3,330,645 | 8/1967 | DeMoustier et al. | 75/59.28 |
| 3,521,874 | 7/1970 | Warfield et al. | 266/265 |
| 4,269,397 | 5/1981 | Strimple et al. | 266/44 |
| 4,340,208 | 7/1982 | Vayssiere et al. | 266/220 |
| 4,413,815 | 11/1983 | Duhomez et al. | 266/265 |
| 4,417,723 | 11/1983 | Kitamura et al. | 266/265 |
| 4,434,976 | 3/1984 | Murakami et al. | 266/268 |
| 4,438,907 | 3/1984 | Kimura et al. | 266/217 |
| 4,465,514 | 8/1984 | Buhrmann et al. | 75/59.25 |
| 4,535,975 | 8/1985 | Buhrmann et al. | 266/220 |
| 4,539,043 | 9/1985 | Miyawaki et al. | 266/265 |
| 4,565,355 | 1/1986 | Jilek et al. | 266/244 |
| 4,647,020 | 3/1987 | Liesch et al. | 266/270 |

FOREIGN PATENT DOCUMENTS

| | | | |
|---|---|---|---|
| 849446 | 8/1970 | Canada | 266/220 |

*Primary Examiner*—L. Dewayne Rutledge
*Assistant Examiner*—Robert L. McDowell
*Attorney, Agent, or Firm*—John I. Iverson

[57] ABSTRACT

Apparatus for introducing reactive and nonreactive gases through the refractory lining of a metallurgical vessel, such as bottom injection of such gases into a BOF to improve mixed blowing efficiency. The apparatus comprises one or more refractory blocks which may be set within a metal canister. The refractory blocks have a plurality of slots each containing one or more small diameter nonreactive metal tubes for conveying gases. The refractory block may also contain means for measuring the rate of wear of the refractory blocks in the canister.

6 Claims, 2 Drawing Sheets

4
15
3
1
12
6
5
5
2
13
12
13
7
8
1
12
12

14
13
13

4
7
14
3
3
15
1
13
5
12
2

APPARATUS FOR INTRODUCING GAS INTO A METALLURGICAL VESSEL

BACKGROUND OF THE INVENTION

In a number of metallurgical processes, it is often desirable to introduce reactive and nonreactive gases beneath the surface of molten metal contained in a refractory lined vessel. In the past, such gases have been introduced into the molten metal through a metal or ceramic tuyere or through a porous refractory element. Porous refractory elements have often resulted in nonuniform gas flow patterns and rapid wear of the porous refractory element, especially when used for introducing reactive gases. Metal or ceramic tuyeres, while providing a more uniform flow of gas, have also been subject to rapid wear and frequently plugging by solidified particles of the molten metal being treated. U.S. Pat. No. 4,535,975 discloses a metal encased refractory gas injection canister in which the gas is injected through a plurality of grooves cut in the refractory. The canister design of this patent is suitable only for low pressure gas injection since the sides of the can may bulge so that the refractory grooves cannot accurately contain high pressure gas flows. Furthermore, this prior design can only be used with gases which would not react with the refractory composition.

SUMMARY OF THE INVENTION

The object of this invention is to provide apparatus for introducing reactive and nonreactive gases through the refractory lining of a metallurgical vessel that will introduce the gases uniformly and without plugging by solidifying particles of the molten metal being treated.

It is a further object of this invention to provide apparatus for introducing gases through the refractory lining of a metallurgical vessel that has a much longer service life than prior gas injection devices.

It is a still further object of this invention to provide apparatus for introducing both reactive and nonreactive high pressure gases into a metallurgical vessel in an accurately controllable manner to improve mixed blowing efficiency.

It has been discovered that the foregoing objectives can be obtained by gas injection apparatus comprising one or more refractory blocks preferably contained within a metal canister. The refractory blocks having a plurality of slots along their faces each containing one or more small diameter nonreactive metal tubes for conveying high pressure gas.

DETAILED DESCRIPTION OF THE INVENTION

Figure 1:
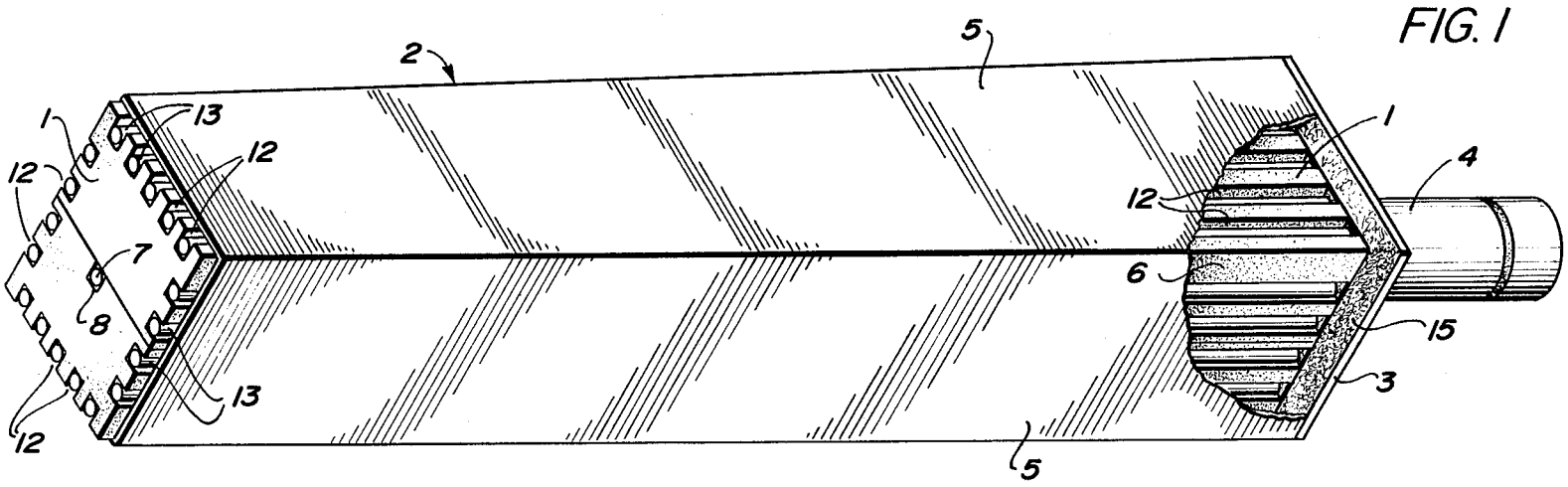
FIG. 1 is an isometric view, partly in section, of one embodiment of the gas injection apparatus of this invention.
Figure 2:
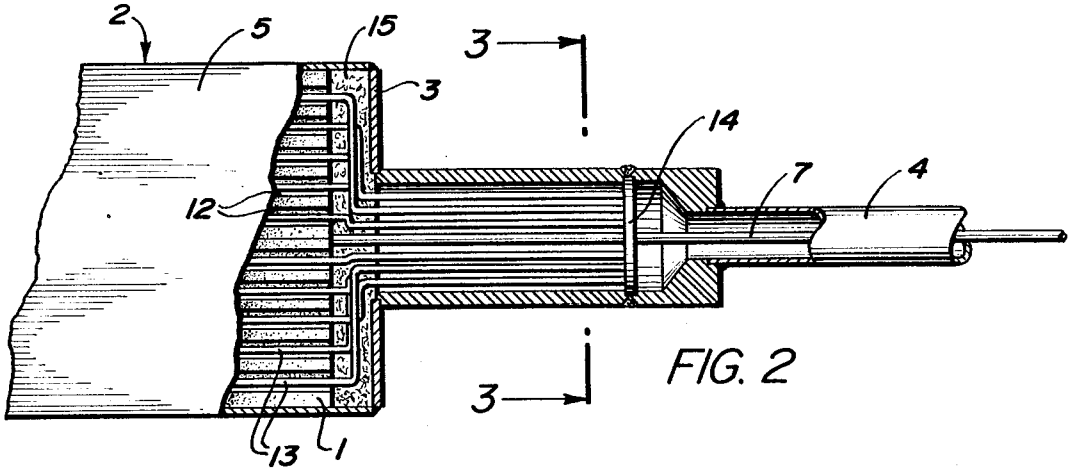
FIG. 2 is an elevation view, partly in section, of the same embodiment of the gas injection apparatus of this invention.

As shown in FIG. 1 and FIG. 2, this invention comprises one or more refractory blocks 1, preferably within a metal canister 2, having a base plate 3 fitted a gas inlet pipe 4 and side walls 5 which are in close proximity to the outerfaces 6 of the refractory block or blocks 1.

The refractory blocks can be of any high quality refractory able to withstand the high temperatures achieved in steelmaking or other metallurgical operations. Since the refractory used for the lining of metallurgical vessels is usually rectangular it is preferred to use similar sized rectangular refractory blocks 1 for this invention but other shapes such as cylindrical could also be used if desired. As shown in FIG. 2, it is preferable to use two blocks 1 cemented together within the canister 2 in order to permit the easy installation of a wire-like refractory wear monitor 7 as described in U.S. Pat. No. 4,269,397. The refractory wear monitor is installed in a slot 8 cut in one of the blocks 1 as best shown in FIG. 1.

Canister 2 is open at the upper end and is imbedded in the refractory lining of the metallurgical vessel so that the open upper end of the canister 2 and refractory blocks 1 are flush with the rest of the refractory lining and are in contact with the molten metal in the vessel.

The walls 5 and base plate 3 of the metal canister 2 are steel, either carbon steel or stainless steel. The space between the backs of the refractory blocks 1 and the base plate 3 of the metal canister 2 is filled with steel wool 15.

Figure 3:
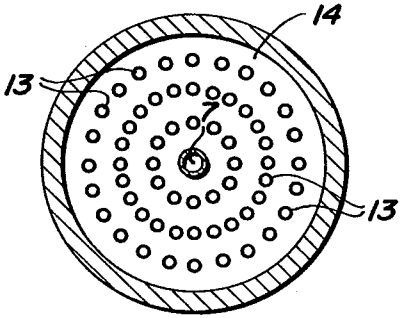
FIG. 3 is a section take along line 3—3 of FIG. 2.

As shown in FIGS. 1 and 2, longitudinal slots 12 are cut all around the faces of the refractory block 1 in close proximity to the side walls 5 of the metal canister 2. The slots 12 are preferably ½" or less apart. A small diameter metal tube 13, preferably stainless steel, is secured in each slot by friction fit and/or grout. Each tube extends the full length of the slot 12 within the canister 2 and terminates and is welded into a flat manifold plate 14 shown in FIG. 3.

Gas inlet pipe 4 permits the reactive or nonreactive gas to be introduced at high pressure behind the gas manifold plate 14 which then distributes the gas to each of the tubes 13. Such an arrangement permits a very uniform flow of high pressure gas around the entire cross-sectional periphery of the canister 2.

Figure 4:
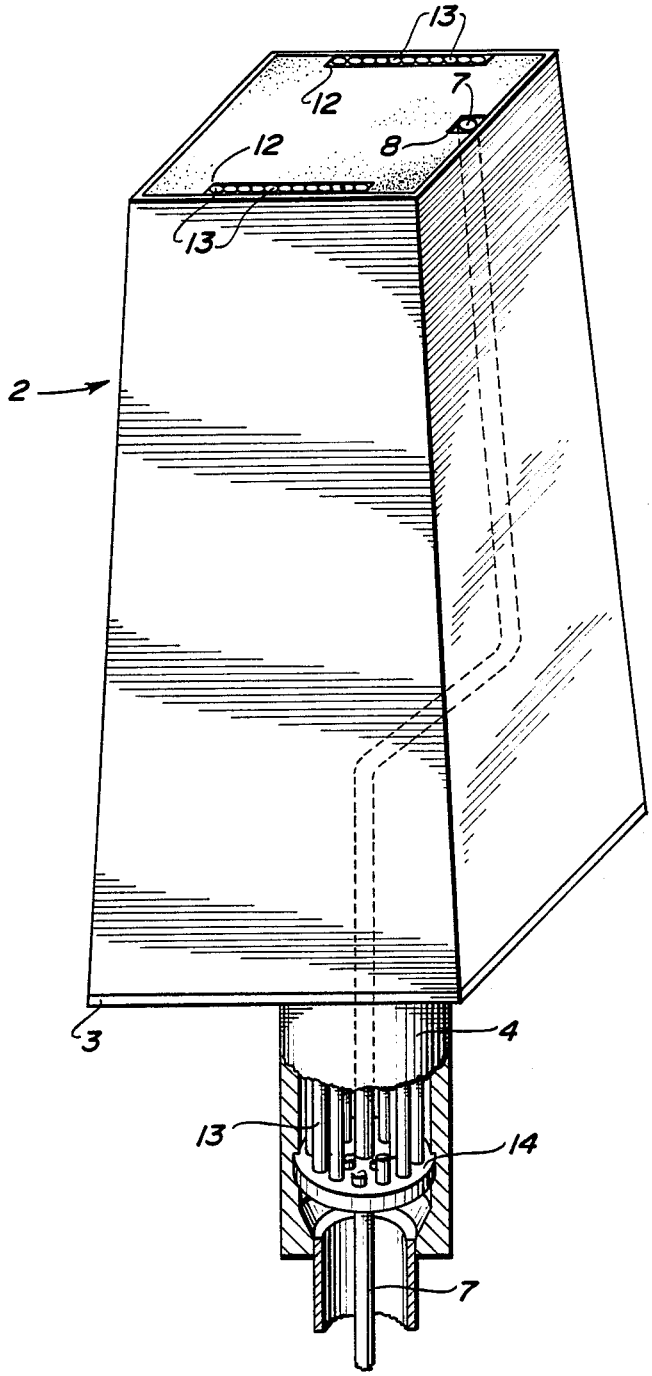
FIG. 4 is an end view illustrating another embodiment of the gas injection apparatus of this invention.

FIG. 4 illustrates another embodiment of this invention for use where a more concentrated flow of gas may be necessary to break through slag accretions that sometimes form on the outer face of canister 2 during service. In this embodiment, instead of placing the tubes 13 being placed all around the periphery of the refractory blocks 1 in individual slots 12 as shown in FIGS. 1 and 2, the tubes 13 are placed side by side, and soldered or welded together in a flat array and installed in a single wide slot 12 on the opposed sides of the refractory block 1. The refractory wear monitor 7 is installed in a separate slot 8 as shown in FIG. 4.

Other variations of the arrangement of the tubes 13 within canister 2 are also possible for special conditions and are to be considered within the scope of this invention.

In one example of the invention illustrated in FIGS. 1 and 2, the metal canister 2 was approximately 12.7 mm square at its upper open end and about 15.2 cm square at its lower end. Two magnesite refractory blocks 1 were cemented together after installing a refractory wear monitor wire (7) in a slot (8) cut in one of the refractory blocks 1, and placed in the canister 2. Thirty-eight slots 12, approximately 1.4 cm apart and 3.5 mm wide and 5 mm deep were cut around the periphery of the refractory blocks 1. Each slot 12 contains a stainless steel tube having a 3.2 mm OD and a 1.7 mm ID grouted into place. Argon gas at a manifold pressure of 300 PSIG was injected into the tubes providing a total flow rate of 180 SCFM of argon from the canister installed in the bottom of a 300 ton basic oxygen furnace.

By use of the apparatus as described above, it is possible to control metal penetration in the tuyere. However, through extensive experimentation and investigation, it has been determined that penetration of melt in the tuyere will not occur if the jet Froude number is greater than about 2400, i.e., in the range of 2400–2500. The jet Froude number (Fr') is a dimensionless number which has been used to describe injection behavior of gases in liquids. The Froude number is the ratio of inertial to body force of a liquid element and is used to describe the movement of liquids. The jet Froude number is a modification of the Froude number and is used to characterize fluid behavior of gas-liquid systems, and it is the ratio of the inertial forces of the jet to the gravitational forces on the liquid. It is given by:

$$Fr' = \frac{P_g V^2}{(P_1 - P_g)gD}$$

where $P_g$=density of gas, $P_1$=density of liquid, V=gas velocity, D=ID of tuyere/nozzle, and g=gravitational constant.

For most gas and liquid systems $P_1 >> P_g$, and therefore the jet Froude number is given by:

$$Fr' = \left(\frac{P_g}{P_1}\right)\frac{V^2}{gD}$$

Accordingly, by using the apparatus of this invention under the parameters set forth above, a practical system of tuyeres for bottom injection of inert or partially reactive gases into a metallurgical vessel, such as a BOF, has been developed. The result is improved mixed blowing efficiency.

We claim:

1. Apparatus for introducing a gas through the refractory lining of a metallurgical vessel comprising at least one refractory block contained within a metal canister, said metal canister having a base plate fitted with a gas inlet manifold, side walls in close proximity to said refractory block and an open end, said refractory block having a plurality of slots in one or more faces thereof adjacent the side walls of said metal canister, each of said slots containing one or more cylindrical metal tubes extending between said open end of said canister and said gas inlet manifold.

2. The apparatus of claim 1 in which the refractory block and said metal canister are rectangular in cross-section.

3. The apparatus of claim 1 including means to measure the wear of said refractory block during service.

4. The apparatus of claim 1 in which the metal tubes and the metal canister are stainless steel.

5. The apparatus of claim 1 in which each slot contains a single tube.

6. The apparatus of claim 1 in which a plurality of tubes are contained in a single slot.

* * * * *